US009802306B2

(12) United States Patent
Miwa et al.

(10) Patent No.: US 9,802,306 B2
(45) Date of Patent: Oct. 31, 2017

(54) IMPACT TOOL

(71) Applicant: MAKITA CORPORATION, Anjo-shi, Aichi (JP)

(72) Inventors: Masao Miwa, Anjo (JP); Masanori Furusawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 617 days.

(21) Appl. No.: 14/498,019

(22) Filed: Sep. 26, 2014

(65) Prior Publication Data

US 2015/0090470 A1 Apr. 2, 2015

(30) Foreign Application Priority Data

Sep. 27, 2013 (JP) ..... 2013-202472

(51) Int. Cl.

*B25D 17/02* (2006.01)
*B25D 17/04* (2006.01)
*B25D 17/24* (2006.01)

(52) U.S. Cl.

CPC ..... *B25D 17/043* (2013.01); *B25D 17/24* (2013.01); *B25D 2211/003* (2013.01); *B25D 2211/068* (2013.01); *B25D 2222/57* (2013.01); *B25D 2250/041* (2013.01); *B25D 2250/371* (2013.01)

(58) Field of Classification Search

CPC ..... B25D 17/02; B25D 17/04; B25D 17/043; B25D 17/24; B25D 2250/041; B25D 2250/371

USPC ..... 173/162.1, 162.2, 117; 16/110.1, 16/430–431

See application file for complete search history.

(56) References Cited

U.S. PATENT DOCUMENTS

| | | | |
|---|---|---|---|
| 4,014,392 | A | 3/1977 | Ross |
| 4,478,293 | A | 10/1984 | Weilenmann et al. |
| 5,921,327 | A | 7/1999 | Henriksson et al. |
| 2007/0144750 | A1 | 6/2007 | Buchenau et al. |

(Continued)

FOREIGN PATENT DOCUMENTS

| | | | |
|---|---|---|---|
| DE | 10 2005 000 207 | A1 | 6/2007 |
| EP | 2 551 061 | A1 | 1/2013 |
| JP | S57-211482 | A | 12/1982 |

(Continued)

OTHER PUBLICATIONS

Mar. 20, 2017 Office Action issued in German Patent Application No. 102014014492.5.

(Continued)

*Primary Examiner* — Michelle Lopez
(74) *Attorney, Agent, or Firm* — Oliff PLC

(57) ABSTRACT

An object of the invention is to provide an impact tool improved in vibration-proofing structure of a handle. A representative impact tool has a tool body and handle. The handle has a handle body and pair of grips that extend in a direction crossing an axial direction of a tool accessory, designed to be held by user's right and left hands. The handle body has a first part to which the grips are connected in a fixed manner and a second part that is connected to the tool body in a fixed manner. The first part is supported against the tool body via an elastic member and is allowed to move with respect to the tool body and the second part while being biased by an elastic force of the elastic member. A current supply cable, supplying current to a motor, is installed on the second part.

9 Claims, 16 Drawing Sheets

(56) References Cited

U.S. PATENT DOCUMENTS

| | | | |
|---|---|---|---|
| 2008/0190632 | A1 | 8/2008 | Berger et al. |
| 2009/0032276 | A1 | 2/2009 | Koch et al. |

FOREIGN PATENT DOCUMENTS

| | | | |
|---|---|---|---|
| JP | H11-508495 | A | 7/1999 |
| JP | A-2007-513784 | | 5/2007 |
| JP | 2011-011296 | A | 1/2011 |

OTHER PUBLICATIONS

Dec. 12, 2016 Office Action issued in Japanese Patent Application No. 2013-202472.

IMPACT TOOL

TECHNICAL FIELD

The present invention relates to a vibration-proofing technique for an impact tool which performs a predetermined hammering operation on a workpiece by striking movement of a tool accessory at least in an axial direction of the tool accessory.

BACKGROUND ART

Japanese Unexamined Patent Application Publication (JP-A) No. 2007-513784 discloses an electric hammer having a pair of handles designed to be held by user's right and left hands. The electric hammer has a cylindrical hood surrounding a periphery of a tool body, and the pair of handles are provided on the cylindrical hood and extend in a direction crossing an axis of striking movement of the hammer. The cylindrical hood is allowed to move in a direction of the axis of the striking movement with respect to the tool body via a roller device including a plurality of rollers and is connected to the tool body by an elastic member.

Patent Document as state of the art is provided with a publication Number: JP-A No. 2007-513784

SUMMARY OF THE INVENTION

Object of the Invention

In the above-described electric hammer described in JP-A No. 2007-513784, the cylindrical hood having the handle mounted thereon is linearly guided in an axial direction of a hammer bit by the roller device including a plurality of rollers, and transmission of vibration from the tool body to the hood is reduced by the elastic member. In the case of the electric hammer described in JP-A No. 2007-513784, however, the vibration-proofing structure of the handle is desired to be further improved.

Accordingly, it is an object of the present invention to provide an impact tool improved in a vibration-proofing structure of a handle.

Invention to Achieve the Object

In order to solve the above-described problem, according to a preferred aspect of the present invention, an impact tool is provided which performs a predetermined operation by driving a tool accessory at least in an axial direction of the tool accessory. The impact tool has a driving mechanism that drives the tool accessory, a motor that drives the driving mechanism, a tool body that houses the driving mechanism and the motor, a handle and a current supply cable that is installed on the handle and is provided to supply current to the motor. The handle has a handle body that is mounted to the tool body, and a pair of grips that extend in a direction crossing the axial direction of the tool accessory and are designed to be held by user's right and left hands. The handle body has a first part to which the grips are fastened and a second part that is fastened to the tool body and to which the first part is connected so as to be movable with respect to the second part. The first part is connected to the tool body via an elastic member and is allowed to move with respect to the tool body and the second part while being biased by an elastic force of the elastic member. The current supply cable is installed on the second part of the handle. Further, the "first part" of the present invention is preferably formed, for example, by an annular member surrounding the tool body around the axis of the tool accessory. The "second part" is preferably formed, for example, by a covering member which is disposed on the tool accessory side of the first part and covers the tool body around the axis of the tool accessory.

According to the present invention, during operation in which the tool accessory is driven in its axial direction, vibration is caused in the tool body. At this time, with the structure in which the pair grips are fastened to the first part of the handle and the first part is connected to the tool body via the elastic member, transmission of vibration from the tool body to the first part and the grip is reduced by the elastic member.

In most impact tools, the center of gravity is located in a region in which the motor and the driving mechanism are concentrated. Generally, the handle is disposed in the vicinity of the center of gravity in consideration of operability of the impact tool. Further, preferably, the current supply cable is installed in the vicinity of the motor in consideration of rational routing of the current supply cable for supplying current to the motor. In the present invention, by provision of the structure in which the current supply cable for supplying current to the motor is installed on the handle, the current supply cable can be installed close to the motor, so that rational routing of the current supply cable can be realized.

Particularly, in the present invention, the current supply cable is installed on the second part of the handle which is fastened to the tool body. Specifically, according to the present invention, the handle body which is a component of the handle has the first part that can move with respect to the tool body and the second part that is fastened to the tool body, and the current supply cable is installed on the second part. With this structure, rational arrangement of the current supply cable can be realized, while the handle can be made vibration-proof. Further, as the "elastic member" in the present invention, a spring is typically used, but rubber may also be used.

According to a further aspect of the impact tool of the present invention, the handle body has a coupling member disposed between the first and second parts. The coupling member connects the first part and the second part while allowing the first part to move with respect to the second part. Further, the "coupling member" in the present invention is typically formed by a bellows formed of an extendable and contractible corrugated member, and preferably by an annular member made of rubber which surrounds the tool body around the axis of the tool accessory.

According to this aspect, the coupling member can serve as a sealing member for closing a clearance between the first and second parts when the first and second parts of the handle body move with respect to each other. Therefore, in a structure, for example, in which the first part is formed by an annular member surrounding the tool body and the second part is formed by a covering member which is disposed on the tool accessory side of the first part and covers the tool body, a dust-proofing cover structure can be rationally provided which avoids dust generated during operation from entering through the clearance between the first and second parts while allowing relative movement of the first and second parts.

According to a further aspect of the impact tool of the present invention, the tool body has a guide member for guiding the first part in the axial direction of the tool accessory. The guide member is formed by a plurality of guide elements which are disposed on an outer periphery of the tool body so as to extend in the axial direction of the tool accessory. Further, the "guide element" in the present invention is typically formed by a rod-like member having a circular section, but it may have a section other than a circular section, such as a T-shaped section, an L-shaped section and a rectangular section.

According to this aspect, with the structure in which the first part is guided by a plurality of the guide elements, the first part can smoothly move in the axial direction of the tool accessory with stability.

According to a further aspect of the impact tool of the present invention, the elastic member is formed by a plurality of elastic elements corresponding to the plurality of guide elements.

According to this aspect, by provision of the elastic elements corresponding to the guide elements, the elastic elements can be arranged such that the biasing force of the elastic member acts on the first part in a balanced manner, so that the first part can be smoothly moved with respect to the tool body and the second part.

According to a further aspect of the impact tool of the present invention, the elastic member is arranged in a position overlapping with the guide member when viewed from a direction crossing the axial direction of the tool accessory.

According to this aspect, the arrangement, in which the guide member and the elastic member are arranged in a position overlapping with each other when the impact tool is viewed from a direction crossing the axial direction of the tool accessory or from the side, is rational in reducing size of the impact tool in the axial direction of the tool accessory.

According to a further aspect of the impact tool of the present invention, the grip is arranged in a position overlapping with the elastic member and the guide member when viewed from a direction crossing the axial direction of the tool accessory.

According to this aspect, the arrangement, in which the grip is arranged in a position overlapping with the elastic member and the guide member when the impact tool is viewed from a direction crossing the axial direction of the tool accessory or from the side, is rational in reducing size of the impact tool in the axial direction of the tool accessory.

According to a further aspect of the impact tool of the present invention, each of the guide elements is formed in a rod shape. Further, each of the elastic elements is a coil spring and is arranged to surround an outer periphery of the guide element.

According to this aspect, by provision of the structure in which the coil spring is arranged to surround the outer periphery of the guide element in proximity, the coil spring is guided by the guide element so as to be prevented from buckling when extending and contracting, so that the extending and contracting movement can be stabilized.

According to a further aspect of the impact tool of the present invention, the handle has a second grip different from the grip, and the second grip is provided in the second part.

According to this aspect, when performing accompanying operations such as standing the impact tool laid on its side and carrying the impact tool, the user can hold the second grip and lift the impact tool. In this case, it is preferred that the second grip is arranged in the second part fixed to the tool body, on a plane extending perpendicularly to the direction of an axis of the striking movement and including the center of gravity of the impact tool. By provision of such arrangement, the balance of the gravity center of the impact tool is improved, so that the impact tool can be easily carried. Further, it is preferred that the second grip is arranged not to protrude to the outside from the outer surface of the second part in order to be prevented from interfering with the operation of the impact tool and from impairing appearance of the impact tool.

According to a further aspect of the impact tool of the present invention, the first part is disposed outside of the tool body. The handle body has a protecting member that is arranged to cover at least part of the outside of the first part and a stopper member that is disposed inside of the first part and defines a moving range of the first part with respect to the tool body. The protecting member and the stopper member are formed of the same elastic material and are connected to each other by a connecting member formed of the same material as the elastic material. Further, the "elastic material" in this aspect typically represents elastomer.

According to this aspect, with the structure in which the protecting member disposed outside of the first part and the stopper member disposed inside of the first part are connected to each other, the protecting member and the stopper member can be rationally prevented from coming off the first part.

Effect of the Invention

According to the present invention, the impact tool is provided which is improved in a vibration-proofing structure of a handle.

REPRESENTATIVE EMBODIMENT OF THE INVENTION

Figure 4:
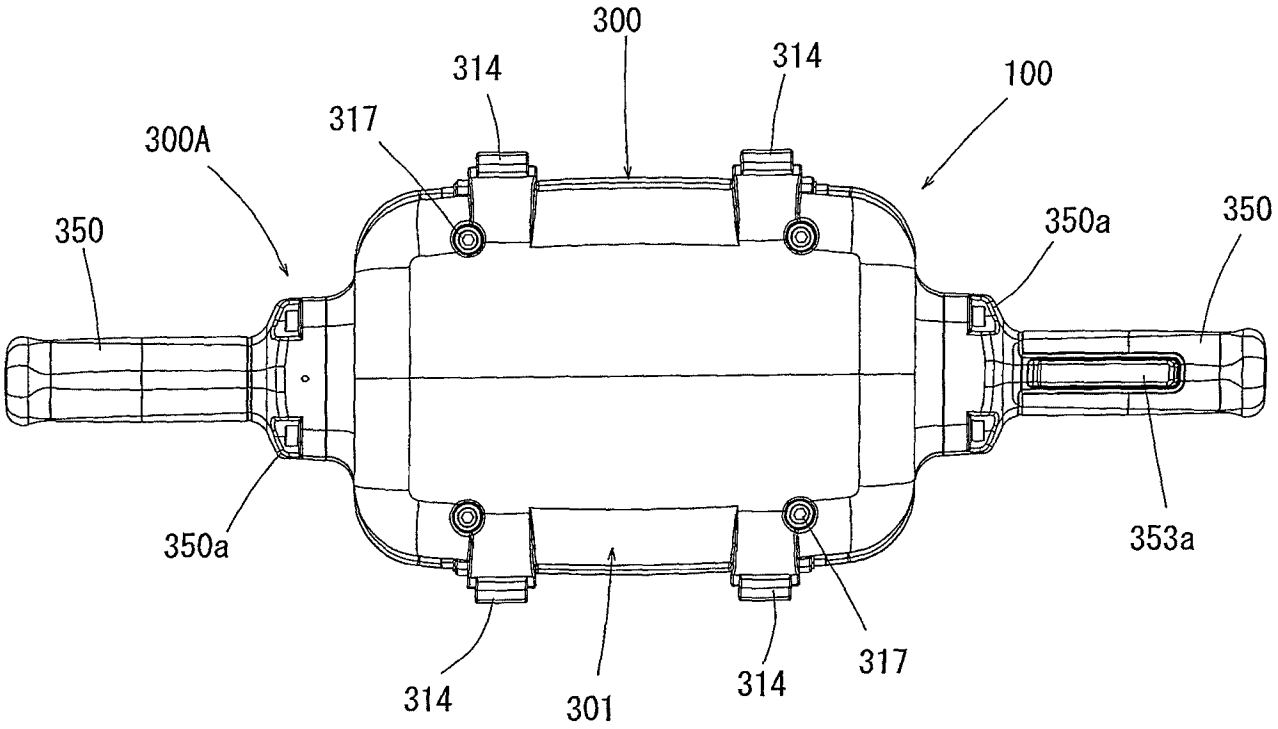
FIG. 4 is a plan view of the impact tool.
Figure 5:
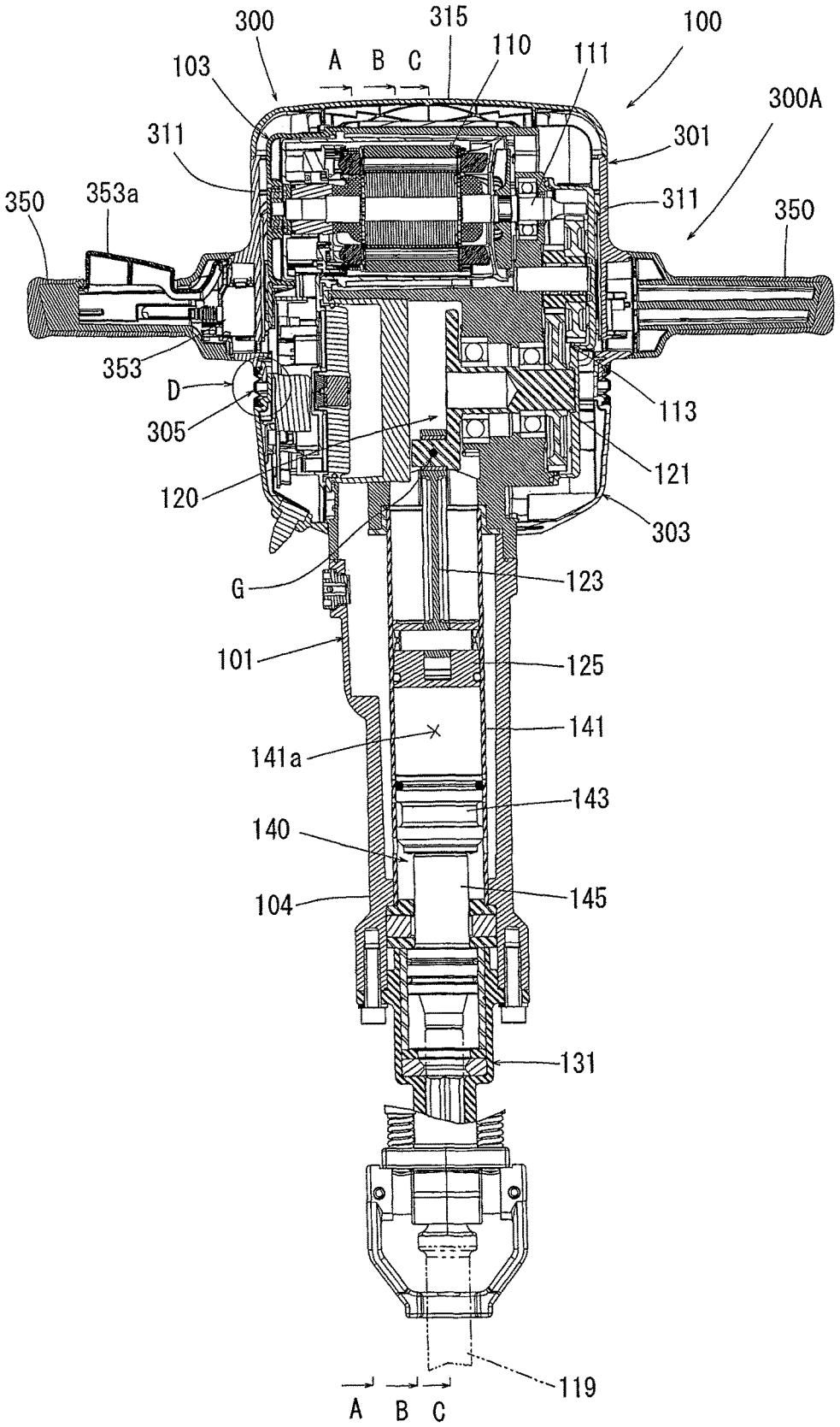
FIG. 5 is a longitudinal sectional view showing an internal structure of the impact tool.

An embodiment of the present invention is now described with reference to FIGS. 1 to 10. In this embodiment, an electric hammer is explained as a representative example of an impact tool according to the present invention. FIGS. 1 to 4 are external views showing an electric hammer 100, and FIG. 5 is a sectional view showing an internal mechanism of the electric hammer 100. The electric hammer 100 according to this embodiment is an impact tool which has a hammer bit 119 coupled to a front end region of a body 101 and performs a chipping operation on a workpiece such as concrete by axial striking movement of the hammer bit 119. The hammer bit 119 is removably coupled to the body 101 via a cylindrical tool holder 131. The hammer bit 119 is inserted into a bit insertion hole of the tool holder 131 and is held such that its relative circumferential rotation is restricted. The hammer bit 119 and the body 101 are example embodiments that correspond to the "tool accessory" and the "tool body", respectively, according to the present invention.

As shown in FIG. 5, the body 101 mainly includes a body housing 103 that houses an electric motor 110 and a motion converting mechanism 120, and a barrel 104 that houses a striking mechanism 140 and part of the tool holder 131. The body housing 103 and the barrel 104 are both made of aluminum and joined together in the axial direction of the hammer bit 119. A handle 300A which is used to operate the electric hammer 100 for performing a chipping operation is arranged on the body 101 on the opposite side to the hammer bit 119 in the axial direction of the hammer bit 119. The handle 300A is an example embodiment that corresponds to the "handle" according to the present invention.

The electric hammer 100 according to this embodiment is a large hammer having the weight of about 30 kg, and basically, a user holds a handgrip 350 of the handle 300A with the hammer bit 110 pointed downward while performing a chipping operation. Therefore, in this embodiment, for the sake of convenience, the hammer bit 119 side in the axial direction of the hammer bit 119 or a longitudinal direction of the body 101 is referred to as the lower side or lower region, and its opposite side is referred to as the upper side or upper region.

The electric motor 110 is driven by power feeding from an AC power source. As shown in FIG. 5, the electric motor 110 is arranged such that a motor shaft 111 of the electric motor 110 intersects with an axial line extending in the axial direction of the hammer bit 119. The motion converting mechanism 120 appropriately converts rotation of the electric motor 110 into linear motion and transmits it to the striking mechanism 140. Then the striking mechanism 140 strikes the hammer bit 119 in the axial direction (downward as viewed in FIG. 1).

The motion converting mechanism 120 serves to convert rotation of the electric motor 110 into linear motion and then transmit it to the striking mechanism 140. The motion converting mechanism 120 is formed by a crank mechanism which is disposed below the electric motor 110 and includes a crank shaft 121, a connecting rod 123 and a piston 125. The crank shaft 121 is driven by the electric motor 110 via a gear reducer 113 including a plurality of gears. The piston 125 forms a driving element for driving the striking mechanism 140 and can slide within a cylinder 141 in the axial direction of the hammer bit 119. The motion converting mechanism 120 is an example embodiment that corresponds to the "driving mechanism" according to the present invention. Further, the crank shaft 121 is disposed in parallel to the motor shaft 111 of the electric motor 110.

The striking mechanism 140 mainly includes a striking element or a striker 143 that is slidably disposed within the cylinder 141, and an intermediate element or an impact bolt 145 that is slidably disposed within the tool holder 131 and transmits the kinetic energy of the striker 143 to the hammer bit 119. The cylinder 141 is concentrically disposed above the tool holder 131 and has an air chamber 141*a* partitioned by the piston 125 and the striker 143. The striker 143 is driven via the action of an air spring of the air chamber 141*a* which is caused by sliding movement of the piston 125. Then the striker 143 collides with the impact bolt 145 and strikes the hammer bit 119 via the impact bolt 145.

A vibration-proofing structure of the handle 300A is now explained. As shown in FIGS. 1 to 5, the handle 300A is disposed on an upper region of the body 101 in the electric hammer 100. The handle 300A mainly includes a grip holding member 300 and a pair of handgrips 350 which can be held by user's right and left hands, respectively. The grip holding member 300 is provided as a member to which a pair of handgrips 350 are fastened. The grip holding member 300 has a rectangular shape which is long substantially in a transverse direction as shown in FIG. 4 when the electric hammer 100 is viewed from above, and also has a cylindrical shape having an open bottom as shown in FIG. 5 when the electric hammer 100 is viewed from the side. The grip holding member 300 is arranged to cover the entire body housing 103 from the outside. Specifically, the grip holding member 300 is provided as a member having a function of holding the pair handgrips 350 and a function as a housing for covering the body housing 103. The grip holding member 300 and the handgrip 350 are example embodiments that correspond to the "handle body" and the "grip", respectively, according to the present invention.

The grip holding member 300 mainly includes an upper region part 301 and a lower region part 303 which are arranged on the upper and lower sides, respectively, in the axial direction of the hammer bit 119, and an annular bellows 305 that connects the upper and lower region parts 301, 303 so as to allow the parts 301, 303 to move with respect to each other in the axial direction of the hammer bit 119. The pair handgrips 350 are fastened to the upper region part 301 of the grip holding member 300. The upper region 301, the lower region 303 and the bellows 305 are example embodiments that correspond to the "first part", the "second part" and the "coupling member", respectively, according to the present invention.

Figure 10:
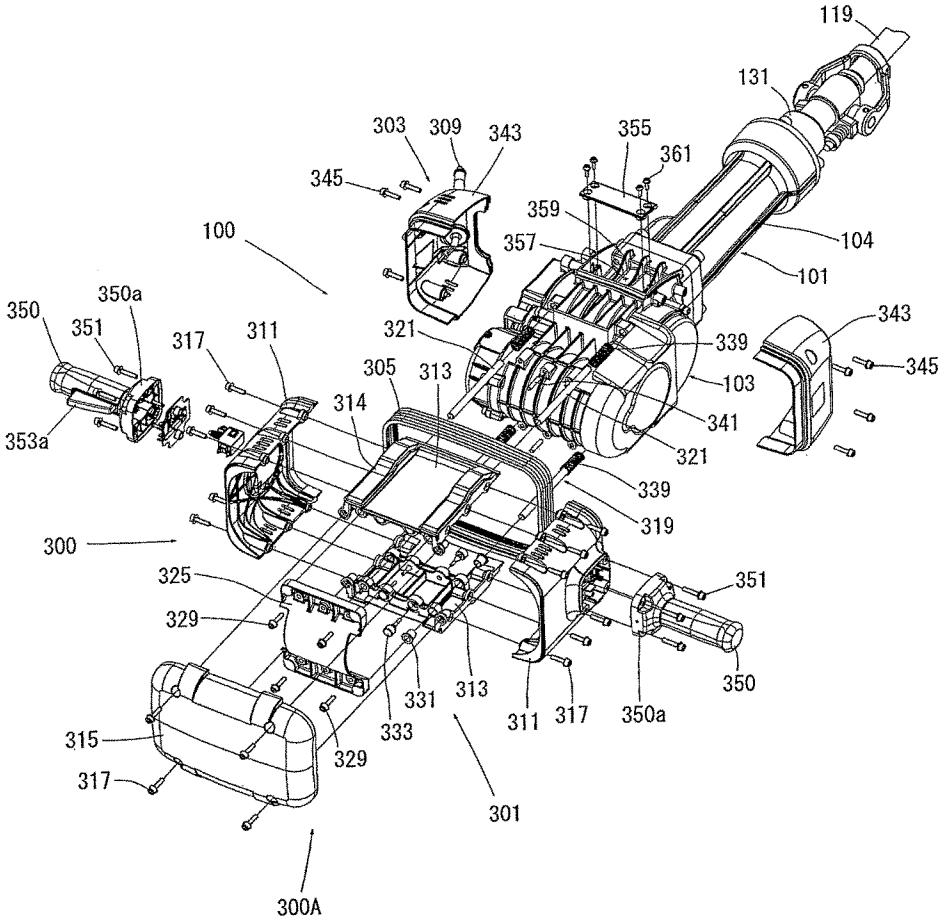
FIG. 10 is an exploded perspective view for illustrating a vibration-proofing structure of a handle.

FIG. 10 is an exploded view of the handle 300A. As shown in FIG. 10, when the electric hammer 100 is viewed from above, the upper region part 301 of the grip holding member 300 has a handle base 311 for forming a left wall, a handle base 311 for forming a right wall, a center cover 313 for forming a front wall, a center cover 313 for forming a rear wall and a head cover 315 for forming an upper wall, all of which are connected and assembled together by a plurality of screws 317. Specifically, the right and left handle bases 311 of the upper region part 301 are connected together via the front and rear center covers 313 and the head cover 315, and the front and rear center covers 313 are connected together via the right and left handle bases 311 and the head cover 315. The assembled upper region part 301 has a rectangular cylindrical shape having an open bottom and forms a covering member for covering an upper region of the body housing 103 around the axis of the hammer bit 119.

The upper region part 301 forms an annular member that surrounds the body housing 103 by the right and left handle bases 311 and the front and rear center covers 313. The right and left handle bases 311 of the components of the annular member are made of synthetic resin and have the same shape. Further, the front and rear center covers 313 are made of synthetic resin and have the same shape. The material of the front and rear center covers 313 is not limited to synthetic resin and may be aluminum or magnesium. The head cover 315 is made of synthetic resin and manufactured as a single part. Further, a strip-shaped protector 314 extending in the axial direction of the hammer bit 119 is provided in a fixed manner on each of outer surfaces of the front and rear center covers 313 so as to cover part of the outer surface of the center cover 313. The protector 314 is made of elastomer and two such protectors 314 are disposed side by side with a predetermined spacing in a direction crossing the axial direction of the hammer bit 119 and protrude outwardly from the outer surface of the center cover 313 with a predetermined height. Specifically, the protectors 314 are provided as a protecting member which protects the grip holding member 300 by coming into contact with the ground before the grip holding member 300 when the electric hammer 100 is put down on its side. The protector 314 is an example embodiment that corresponds to the "protecting member" according to the present invention.

As shown in FIGS. 5 to 8, the upper region part 301 is disposed to cover an upper part of the body housing 103 and mounted to the body housing 103 so as to be movable in the axial direction of the hammer bit 119 with respect to the body housing 103. Specifically, the body housing 103 has a slide guide 319 for guiding the upper region part 301 in the axial direction of the hammer bit 119. Thus, the front and rear center covers 313 of the upper region part 301 are guided by the slide guide 319 provided on the body housing 103. The slide guide 319 includes four guide shafts 321 which have a circular section and are disposed at the right/left front/rear of the outer periphery of the body housing 103 (see FIGS. 6 and 10). The guide shafts 321 are disposed to be vertically and horizontally symmetrical with respect to an axis extending in the axial direction of the hammer bit 119 when the electric hammer 100 is viewed from above. The slide guide 319 and the guide shaft 321 are example embodiments that correspond to the "guide member" and the "guide element", respectively, according to the present invention.

Figure 6:
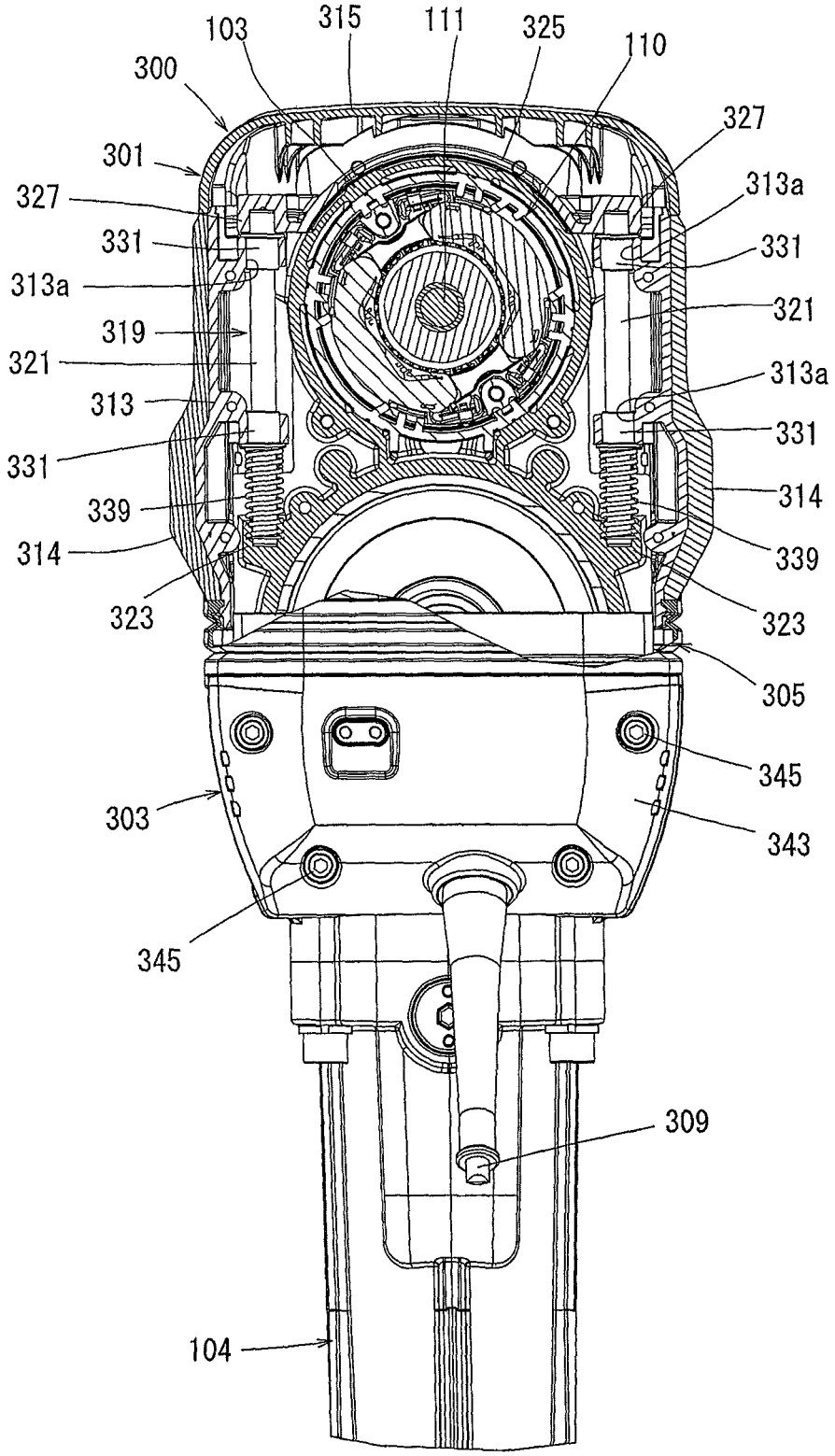
FIG. 6 is a sectional view taken along line A-A in FIG. 5.

Each of the guide shafts 321 is made of iron and extends in parallel to the axial direction of the hammer bit 119 as shown in FIG. 6. Further, one end (a lower end) of the guide shaft 321 in its extending direction is supported by a shaft receiving recess 323 formed on the outside of the body housing 103 and the other end (an upper end) in its extending direction is supported by a receiving recess 327 of a top plate 325. The top plate 325 is fastened to an upper surface of the body housing 103 by a plurality of screws 329 (see FIG. 10). The center cover 313 has upper and lower guide holes 313*a* in the axial direction of the hammer bit 119 and is slidably fitted onto the guide shaft 321 via a slide bush 331 fitted in each of the guide holes 313*a*. Further, the front center cover 313 is guided by the two front guide shafts 321 and the rear center cover 313 is guided by the two rear guide shafts 321.

Figure 7:
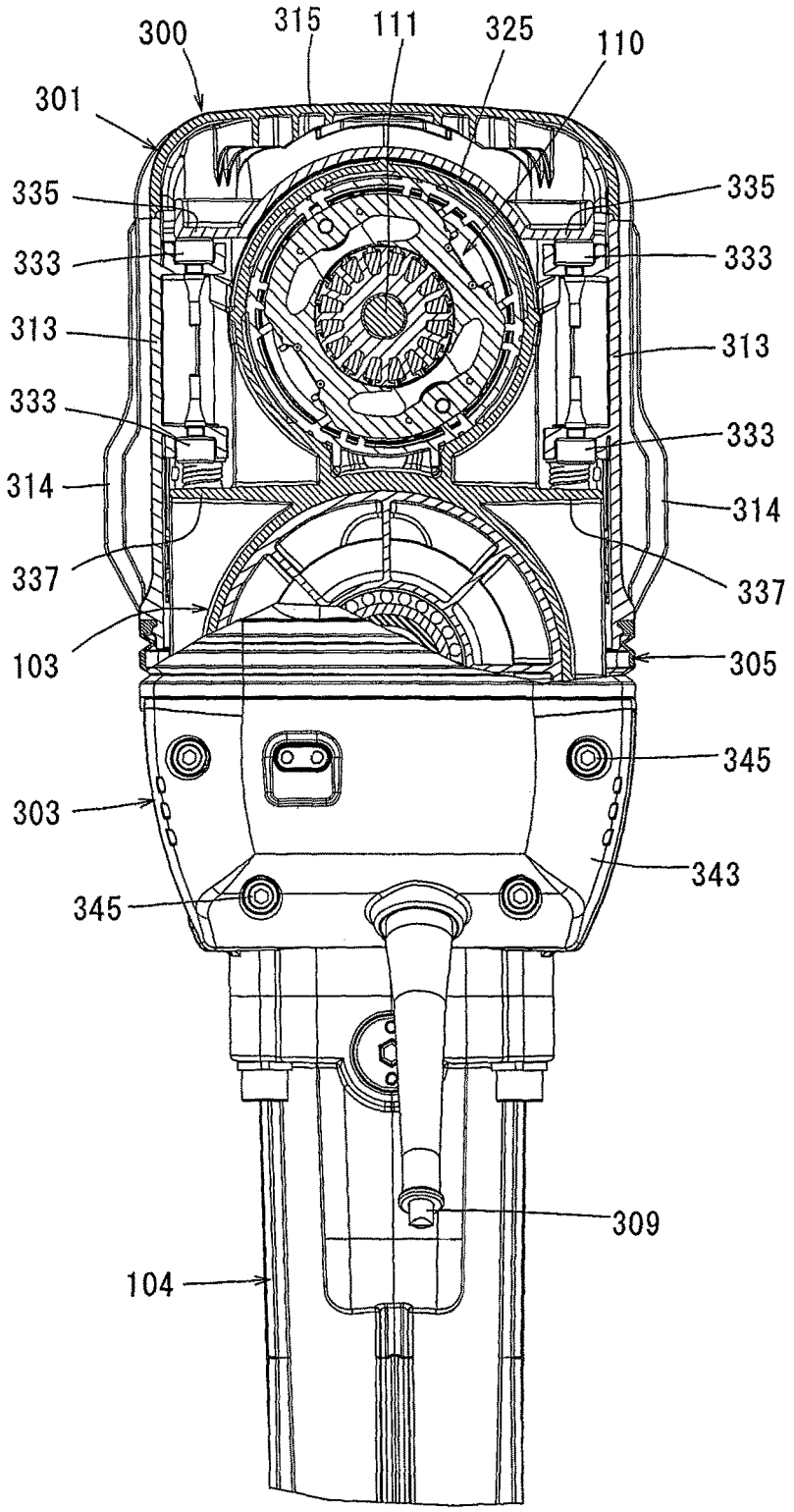
FIG. 7 is a sectional view taken along line B-B in FIG. 5.

As shown in FIG. 7, a pair of upper and lower stoppers 333 are provided in a fixed manner on the inside of the center cover 313 of the upper region part 301 and define a moving range of the upper region part 301 with respect to the body housing 103. The stoppers 333 are example embodiments that correspond to the "stopper member" according to the present invention. The stoppers 333 are made of elastomer and disposed between the right and left guide shafts 321. An upper end surface of the upper stopper 333 is opposed to a flat lower surface of an upper contact part 335 of the top plate 325 so as to be allowed to come into contact therewith, and a lower end surface of the lower stopper 333 is opposed to a flat upper surface of a lower contact part 337 of the body housing 103 so as to be allowed to come into contact therewith. The upper stopper 333 defines an uppermost end position of the upper region part 301 by contact with the upper contact part 335 of the top plate 325, and the lower stopper 333 defines a lowermost end position of the upper region part 301 by contact with the lower contact part 337 of the body housing 103.

As shown in FIG. 6, a compression coil spring 339 is arranged to surround each of the guide shafts 321. Specifically, the compression coil spring 339 is loosely fitted onto the guide shaft 321 with a slight clearance from an outer periphery of the guide shaft 321. The compression coil spring 339 is provided as a member for elastically connecting the center cover 313 and the body housing 103. The compression coil spring 339 is an example embodiment that corresponds to the "elastic member" and the "elastic element" according to the present invention. One end of the compression coil spring 339 is received by the shaft receiving recess 323 of the body housing 103 and the other end is received by the lower slide bush 331 of the center cover 313. The compression coil spring 339 is assembled in the state that a prescribed load is preliminarily applied thereto. Thus, an upward biasing force is applied to the center cover 313, so that the upper region part 301 is held in a position in which the upper stopper 333 is brought in contact with the lower surface of the upper contact part 335 of the top plate 325. This position is an initial position of the upper region part 301.

Figure 8:
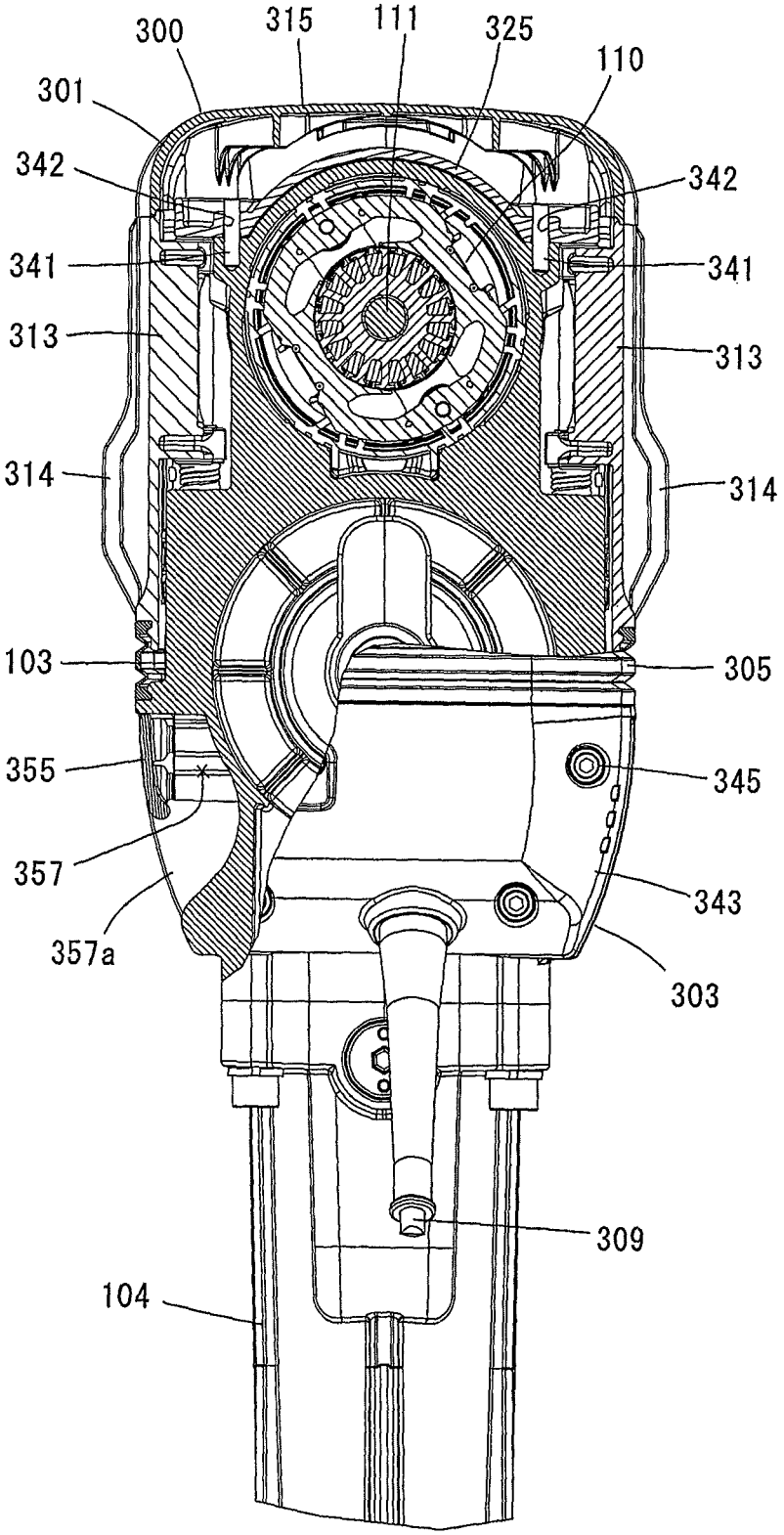
FIG. 8 is a sectional view taken along line C-C in FIG. 5.

When tightening the screws 329 to fasten the top plate 325 to the body housing 103, the top plate 325 presses the compression coil spring 339 downward via the upper stopper 333 and the center cover 313, so that load is applied to the compression coil spring 339. Further, as shown in FIG. 8, a plurality of positioning pins 341 for the top plate 325 are provided on the body housing 103, and positioning holes 342 formed in the top plate 325 are fitted onto the positioning pins 342. In this manner, the top plate 325 can be easily mounted to the body housing 103. Further, the head cover 315 is mounted to the center cover 313 after the top plate 325 is mounted to the body housing 103.

As shown in FIG. 5, the handgrips 350 are mounted to outer surfaces of the right and left handle bases 311 of the upper region part 301 in a fixed manner. Each of the handgrips 350 is a hollow cylindrical member made of synthetic resin and has a flange-like base 350*a* on one axial end. The base 350*a* is connected to the outer surface of the handle base 311 in a fixed manner by a plurality of screws 351 (see FIG. 10), and the other axial end of the handgrip 350 extending in a horizontal direction crossing the axial direction of the hammer bit 119 is a free end. Specifically, the handgrip 350 is connected to the handle base 311 in a cantilever form.

A switch 353 is provided in one of the pair handgrips 350 and configured to be operated to drive and stop the electric motor 110. The switch 353 is mostly housed within the handgrip and part of a switch lever 353*a* which serves as a switch operation member protrudes from the outer surface of the handgrip 350. When the user holds the handgrip 350 and presses the switch lever 353*a* with the finger(s) or palm, the electric motor 110 is driven, and when the pressed switch lever 353*a* is released, the electric motor 110 is stopped.

Figure 9:
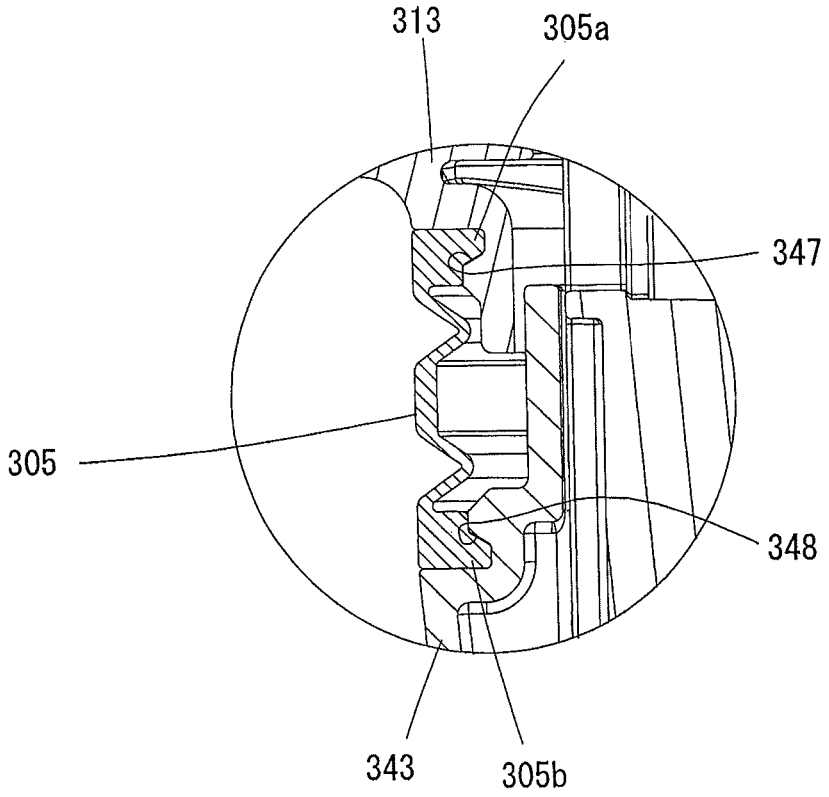
FIG. 9 is an enlarged view of part D in FIG. 5.

As shown in FIG. 10, the lower region part 303 mainly includes a left side cover 343, a right side cover 343 and a knob 355 that is disposed between the side covers 343 and can be held by the user. The right and left side covers 343 are made of synthetic resin and, as shown in FIGS. 1 to 8, are arranged to cover the entire right and left side surfaces, part of the front surface and part of the rear surface of a lower region of the body housing 103 and fastened to the body housing 103 by a plurality of screws 345 (see FIG. 10). The knob 355 made of synthetic resin is arranged in a region, which corresponds to a front surface of the electric hammer 100, between the right and left side covers 343 in a circumferential direction of the hammer bit 119 and is fastened to a front surface of the body housing 103. Specifically, the lower region part 303 forms an annular covering member for covering the lower region of the body housing 103 around the axis of the hammer bit 119. As shown in FIG. 9, lower ends of the handle base 311 and the center cover 313 of the upper region part 301 are arranged to fit onto the upper end of the side cover 343 so as to be slidable, so that the upper region part 301 is allowed to move with respect to the lower region part 303.

The bellows 305 which can extend and contract in the axial direction of the hammer bit 119 is disposed between a lower end of the upper region part 301 and an upper end of the lower region part 303. The bellows 305 is made of rubber and provided as an annular extendable/contractible corrugated covering member that surrounds a region between the lower end of the upper region part 301 and the upper end of the lower region part 303. As shown in FIG. 9, one peripheral edge 305*a* of the bellows 305 is engaged with an engagement recess 347 which is formed in outer peripheral surfaces of lower end portions of the handle base 311 and the center cover 313 in the upper region part 301, and the other peripheral edge 305*b* of the bellows 305 is engaged with an engagement recess 348 which is formed in outer surfaces of the side covers 343 of the lower region part 303 and the outer surface of the body housing 103.

The bellows 305 disposed between the lower end of the upper region part 301 and the upper end of the lower region part 303 closes a clearance between the upper region part 301 and the body housing 103 and a clearance between the upper region part 301 and the lower region part 303, while allowing the upper region part 301 to move with respect to the body housing 103 and the lower region part 303 by extension and contraction of the bellows 305. Therefore, dust generated during operation is prevented from entering the inside of the grip holding member 300 or a space between an inner surface of the grip holding member 300 and an outer surface of the body housing 103 through the clearance. Further, electric equipment (not shown) such as a controller for controlling the electric motor 110 is disposed between the inner surface of the grip holding member 300 and the outer surface of the body housing 103. Therefore, the bellows 305 can protect the electric equipment from dust by preventing entry of dust.

A current supply cable 309 for supplying current to the electric motor 110 is installed on one of the pair side covers 343 which forms the lower region part 303. Specifically, the current supply cable 309 is attached to the handle 300A and current is supplied to the electric motor 110 through the handle 300A. Further, the current supply cable 309 is installed on the lower region part 303 of the handle 300A which is fastened to the body housing 103. Thus, the position of the current supply cable 309 with respect to the electric motor 110 is held constant.

Figure 1:
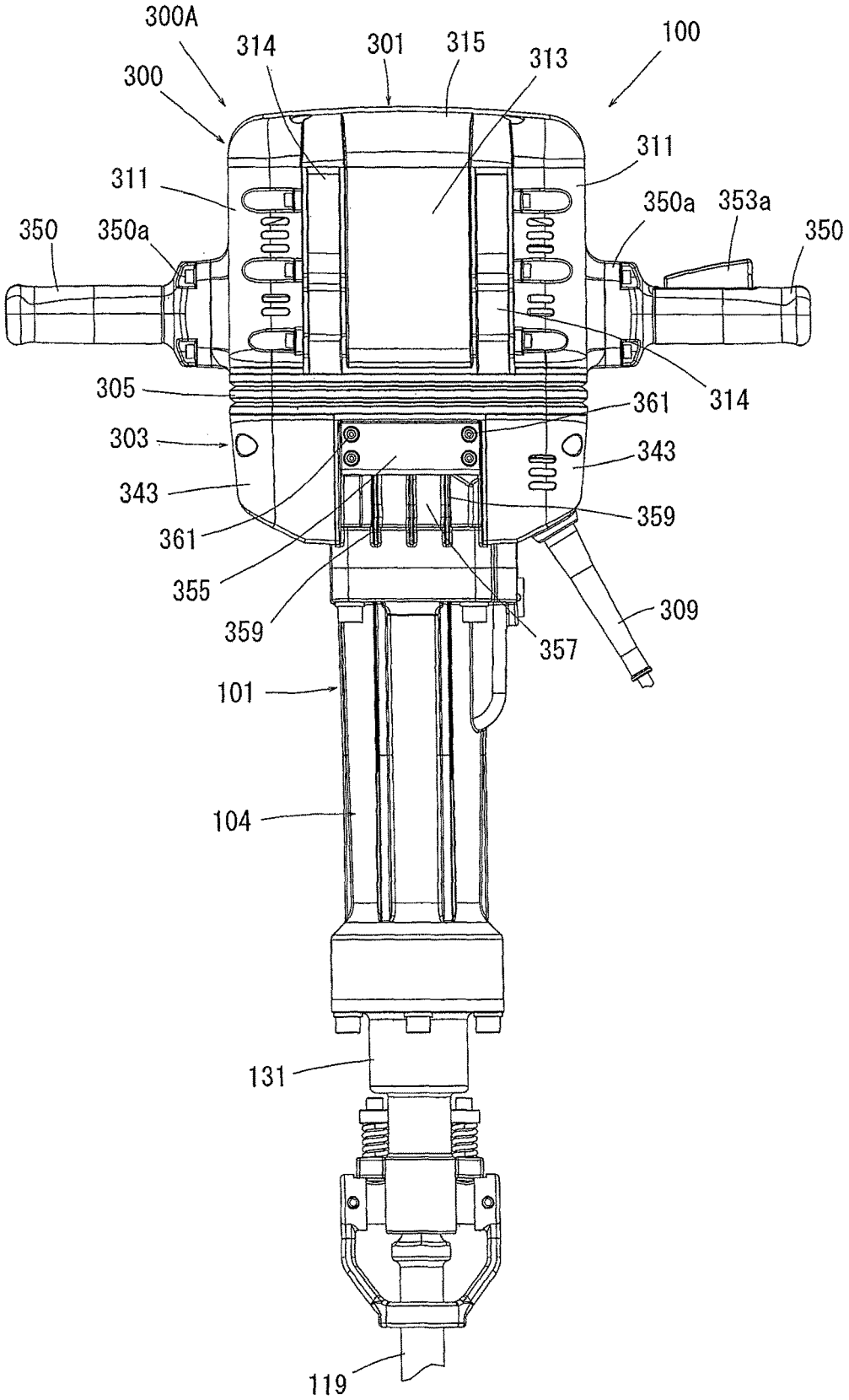
FIG. 1 is a front view of an impact tool according to this embodiment.
Figure 2:
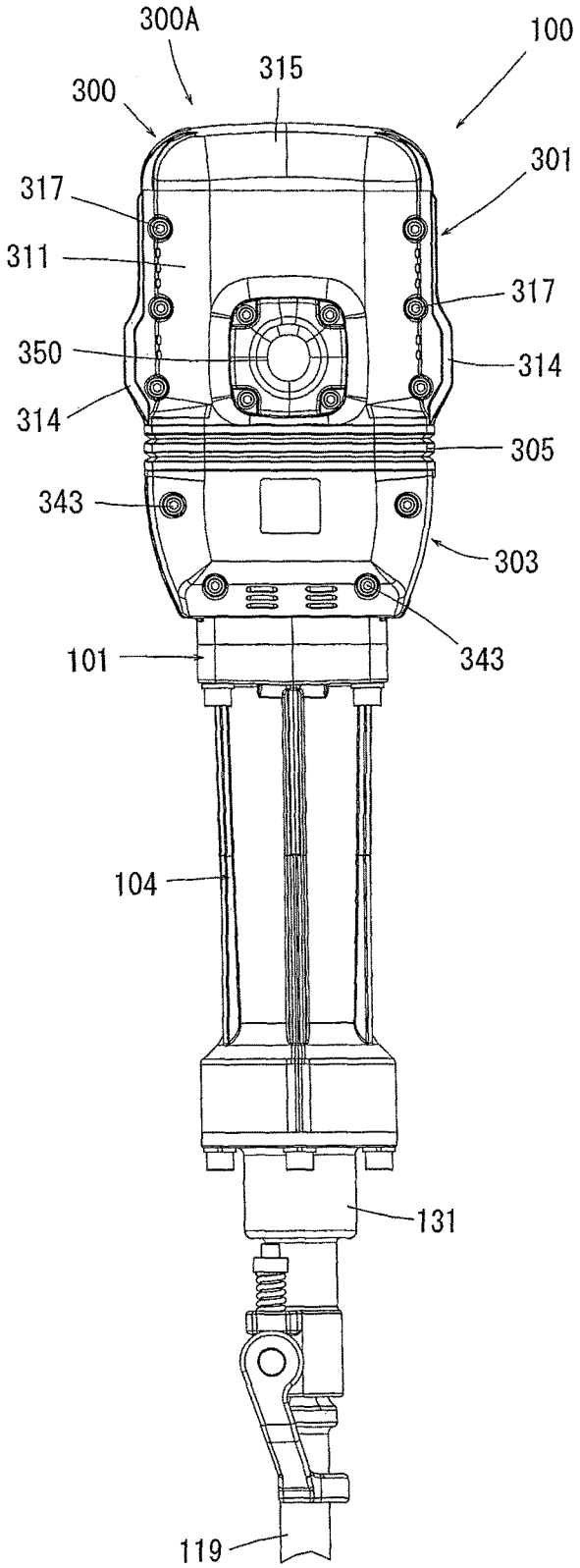
FIG. 2 is a left side view of the impact tool.
Figure 3:
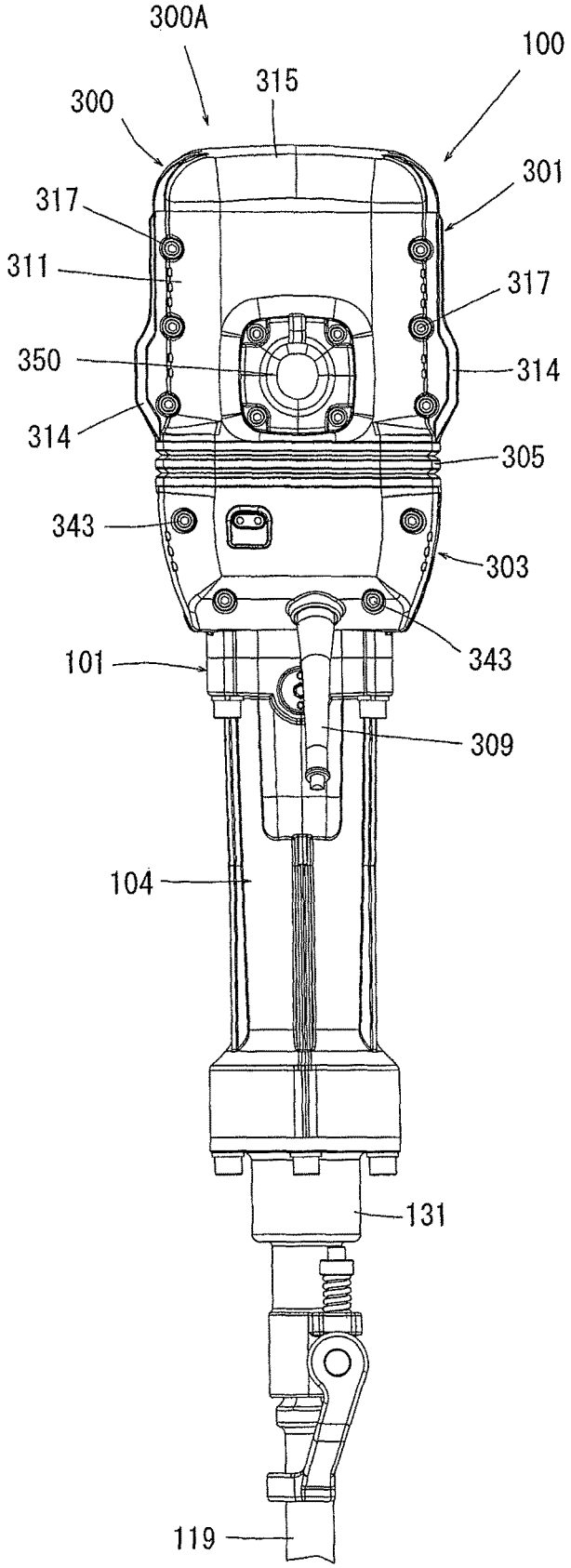
FIG. 3 is a right side view of the impact tool.

The knob 355 which is one of the components of the lower region part 303 can be used for performing accompanying operations other than a chipping operation, such as standing the electric hammer 100 laid on its side and carrying the electric hammer 100. The knob 355 is an example embodiment that corresponds to the "second grip" according to the present invention. As shown in FIGS. 1, 8 and 10, a recess 357 for disposing the knob 355 is formed between the right and left side covers 343 on the front surface of the body housing 103 and is provided with a plurality of ribs 359 extending in the axial direction of the hammer bit 119. The ribs 359 are disposed at predetermined intervals, specifically large enough to insert a user's finger between the ribs, in a direction crossing the axial direction of the hammer bit 119.

The knob 355 is formed by a substantially rectangular plate-like member. The knob 355 is placed on the top of the ribs 359 so as to cover an upper half of the recess 357 and fastened to the body housing 103 by a plurality of screws 361. A lower half of the recess 357 which is not covered by the knob 355 forms a finger insertion open space 357*a* for inserting user's fingers in between the ribs 359. Thus, the user can insert the fingers in between the ribs 359 through the open space 357*a* and hold the knob 355. The knob 355 is disposed on the front surface of the lower region part 303 as described above, and an outer surface of the knob 355 is arranged to be flush with the front surface of the lower region part 303. Further, in lieu of the structure in which the knob 355 is fastened to the body housing 103, the knob 355 may be fastened to the lower region part 303.

The electric hammer 100 of this embodiment is mainly used for an operation in which the hammer bit 119 is pointed downward. In this electric hammer 100, a center of gravity G of the electric hammer 100 is located in an upper region on an axis extending in the axial direction of the hammer bit 119, in which the electric motor 110 and the motion converting mechanism 120 are concentrated, or specifically in the vicinity of the crank shaft 121 (see FIG. 5). Therefore, it is preferred that the knob 355 is arranged in the lower region part 303 on a plane extending perpendicularly to the axial direction of the hammer bit and passing through the center of gravity G of the electric hammer 100.

The electric hammer 100 according to this embodiment is constructed as describe above. Therefore, the user holds the pair handgrips 350 provided on the outer surfaces of the handle bases 311 of the upper region part 301 with the right and left hands and presses the switch lever 353*a* with the hammer bit 119 pointed downward to drive the electric motor 110. Then the user can perform the chipping operation on a workpiece by linearly moving the hammer bit 119.

In the above-described chipping operation, impulsive and cyclic vibration is caused in the body 101 of the electric hammer 100 in the axial direction of the hammer bit 119. In this embodiment, the handle 300A includes the grip holding member 300 and the pair handgrips 350. Further, the grip holding member 300 includes the upper region part 301, the lower region part 301 and the bellows 305 that connects the upper and lower region parts 301, 303 so as to allow the parts 301, 303 to move with respect to each other. The upper region part 301 is connected to the body housing 103 via the compression coil spring 339. When the compression coil spring 339 is elastically deformed by the above-described vibration caused in the body 101, the upper region part 301 and the handgrips 350 fastened to the upper region part 301 are relatively moved in the axial direction of the hammer bit 119 with respect to the vibration. As a result, transmission of vibration from the body housing 103 to the upper region part 301 and the handgrips 350 is reduced.

In the electric hammer 100 according to this embodiment, as described above, the center of gravity G is located in the region in which the electric motor 110 and the motion converting mechanism 120 are concentrated. Generally, the handle 300A is disposed in the vicinity of the center of gravity G in consideration of operability of the electric hammer 100. Further, preferably, the current supply cable 309 is installed in the vicinity of the electric motor 110 in consideration of rational routing of the current supply cable 309 for supplying current to the electric motor 110. In this embodiment, by provision of the structure in which the current supply cable 309 for supplying current to the electric motor 110 is installed on the handle 300A, the current supply cable 309 can be installed close to the electric motor 110, so that rational routing of the current supply cable 309 can be realized.

Particularly, in this embodiment, the grip holding member 300 is split into two elements in the axial direction of the hammer bit 119. One split element forms the upper region part 301 that is connected to the body housing 103 via the compression coil spring 339 so as to be movable with respect to the body housing 103, and the other split element forms the lower region part 303 fastened to the body housing 103. The current supply cable 309 is installed on the lower region part 303. With such a structure, the current supply cable 309 can be connected in a rational manner to the body housing 103 in which the electric motor 110 is housed, while the grip holding member 300 and the handgrip 350 can be made vibration-proof.

According to this embodiment, with the structure in which the extendable and contractible bellows 305 is disposed between the upper region part 301 and the lower region part 303, the bellows 305 closes the clearance between the upper region part 301 and the lower region part 303 so as to prevent dust from entering the internal space of the grip holding member 300 through the clearance, while allowing the upper region part 301 to move with respect to the body housing 103 and the lower region part 303. Especially, in the structure in which electric equipment, etc. is disposed by utilizing the internal space between the body housing 103 and the grip holding member 300 covering the body housing 103, the electric equipment, etc. can be protected from dust.

According to this embodiment, the four guide shafts 321 are provided on the body housing 103 and extend in parallel to the axial direction of the hammer bit 119, while the slide bush 331 is provided in the upper region part 301 and can slide with respect to the guide shaft 321, so that the upper region part 301 is guided by using the guide shaft 321. With such a structure, the upper region part 301 can smoothly move with respect to the body housing 103 with stability.

According to this embodiment, with the structure in which the compression coil spring 339 is provided in each of the four guide shafts 321, the biasing forces of the four compression coil springs 339 can be applied to the upper region part 301 in a balanced manner. Further, the compression coil spring 339 is arranged to surround the outer periphery of the guide shaft 321. Specifically, the compression coil spring 339 is loosely fitted onto the guide shaft 321 with a slight clearance from the outer periphery of the guide shaft 321. With such a structure, the compression coil spring 339 is prevented from budding when compressively deformed, so that the operation of the compression coil spring 339 is stabilized.

According to this embodiment, the guide shaft 321 and the compression coil spring 339 fitted onto the guide shaft 321 are arranged at the same position in the axial direction of the hammer bit 119. The handgrip 350 is also arranged at the same position as the compression coil spring 339 and the guide shaft 321 in the axial direction of the hammer bit 119. Such arrangement is rational in reducing size of the electric hammer 100 in the axial direction of the hammer bit 119.

According to this embodiment, the right and left handle bases 311 are formed symmetrically with respect to an axis extending in the longitudinal direction and the front and rear center covers 313 are also formed symmetrically with respect to this longitudinal axis. Specifically, the right and left handle bases 311 have the same shape, and the front and rear center covers 313 also have the same shape. Thus, several components are formed by the same parts, so that the manufacturing costs can be reduced.

According to this embodiment, the knob 355 which can be used when lifting the electric hammer 100 is disposed on the front of the lower region part 303. Therefore, the operation of standing the electric hammer 100 laid on its side or carrying the electric hammer 100 can be easily performed by using the knob 355. The knob 355 is disposed in the vicinity of the center of gravity G of the electric hammer 100 in the axial direction of the hammer bit 119. In this respect, preferably, the mounting position of the knob 355 is determined especially in consideration of the weight balance of the electric hammer 100 during conveyance.

In this embodiment, in order to provide the knob 355, the recess 357 is formed in the body housing 103 and the ribs 359 are provided in the recess 357. With such a structure, rigidity around the knob 355 can be enhanced. Further, with the structure in which the outer surface of the knob 355 is formed to be flush with the outer surfaces of the side covers 343, the knob 355 does not interfere with the operation of the hammer and does not impair appearance of the hammer. Further, the knob 355 may be omitted or may be disposed in the upper region part 301.

Another embodiment of the present invention is now explained with reference to FIGS. 11 to 15. This embodiment is a modification to the above-described embodiment relating to the elastomer protectors 314 that are provided to protect the grip holding member 300 and are arranged to partly cover the center cover 313 and to the elastomer stoppers 333 that are provided to define the moving range of the upper region part 301 with respect to the body housing 103 and are disposed on the inside of the center cover 313. The protectors 314 and the stoppers 333 are example embodiments that correspond to the "protecting member" and the "stopper member", respectively, according to the present invention.

Figure 12:
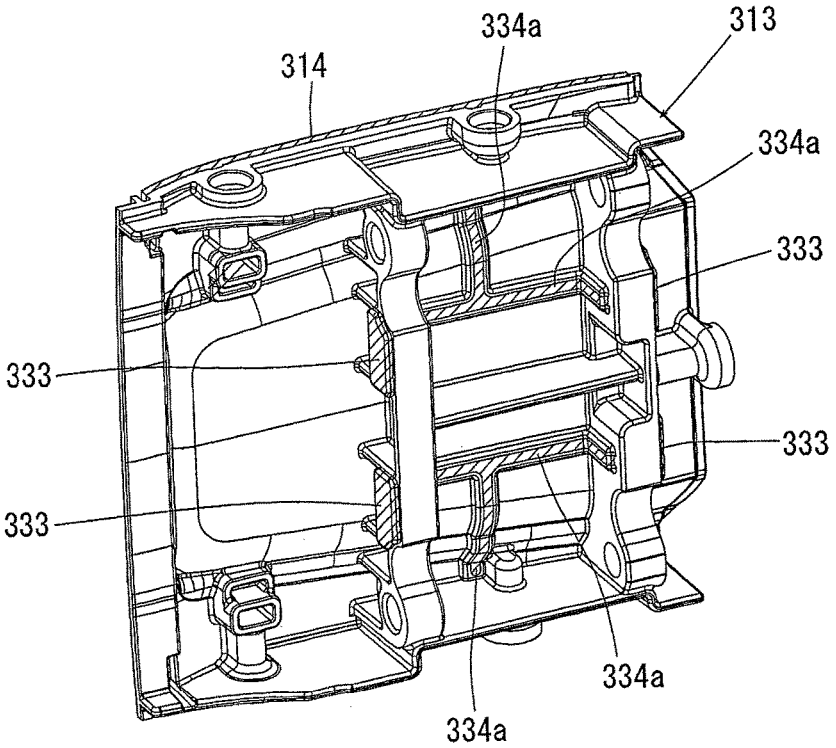
FIG. 12 is also a perspective view of the center cover as viewed from the inside.
Figure 13:
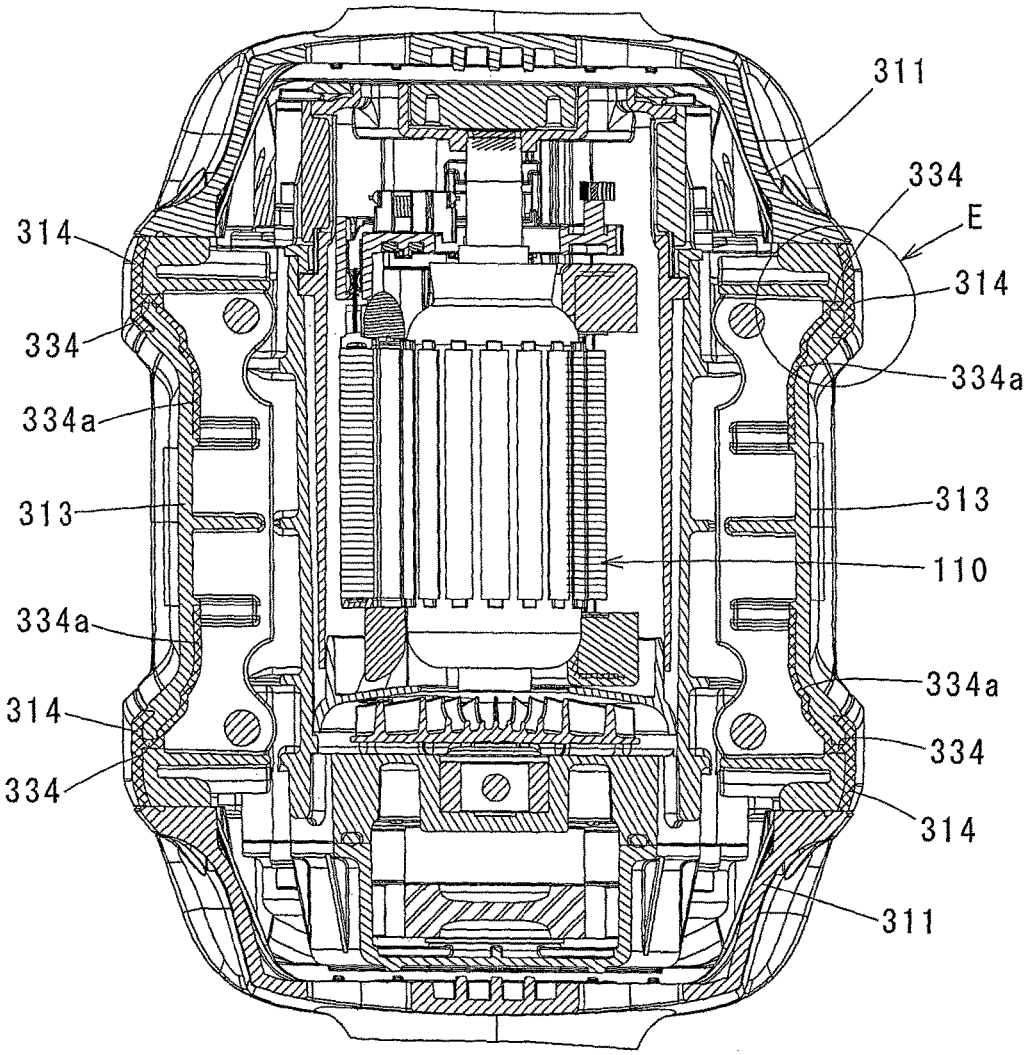
FIG. 13 is a sectional view showing a connecting part which connects a protector and a stopper.
Figure 14:
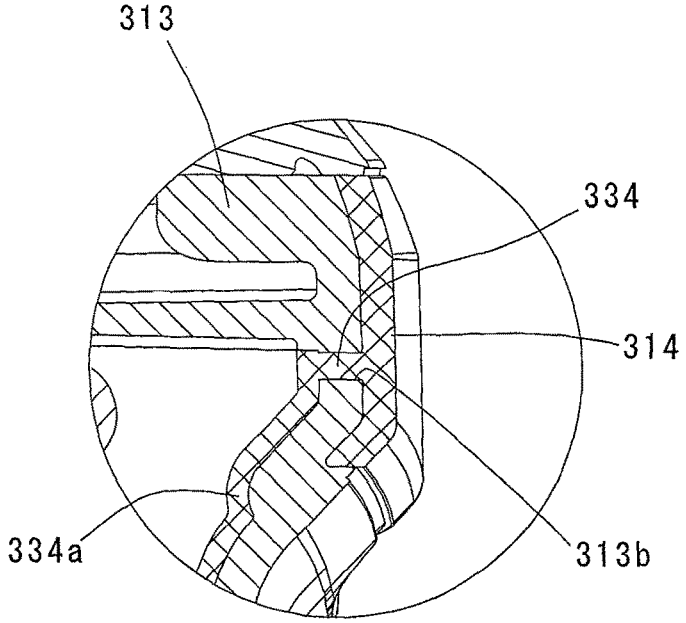
FIG. 14 is an enlarged view of part E in FIG. 13.
Figure 15:
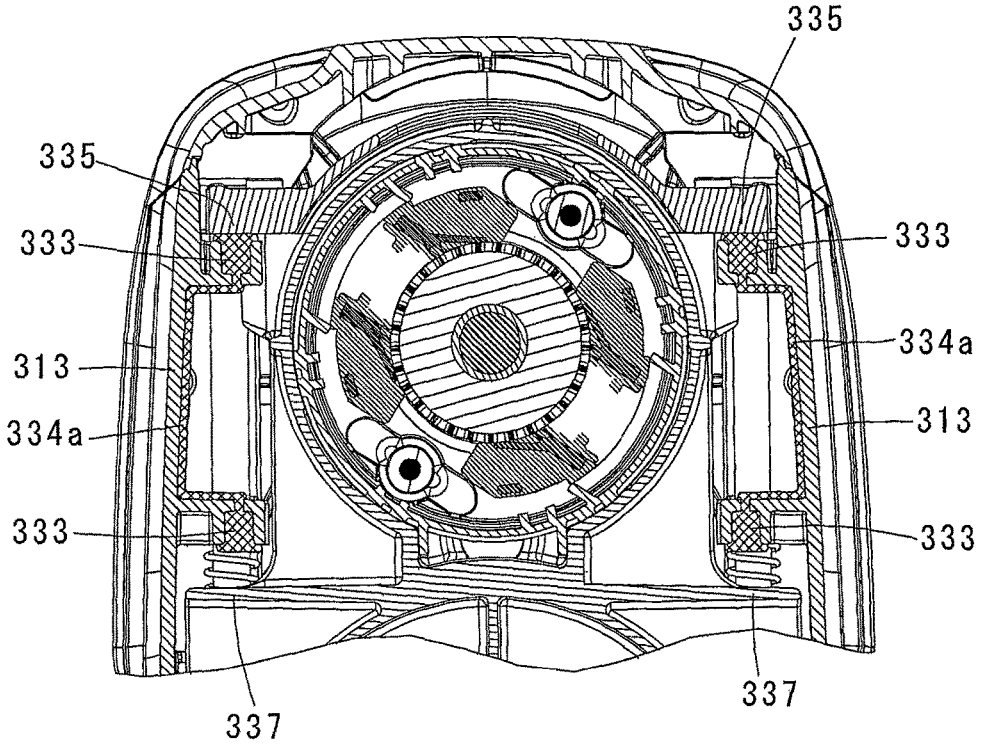
FIG. 15 is a sectional view for illustrating connection between an extension extending from the connecting part and the stopper.

In this embodiment, as shown in FIGS. 13 to 15, each of the protectors 314 disposed on the outside of the center cover 313 is connected with the pair stoppers 333 disposed on the inside of the center cover 313 by a connection part 334 made of elastomer and extending through a wall surface of the center cover 313 and by an extension 334*a* made of elastomer and extending from one (inner) end of the connection part 334. The connection part 334 is located in a penetrating manner in a through hole 313*b* formed in the center cover 313 and extending in a direction crossing the axial direction of the hammer bit 119, and the other (outer) end of the connection part 334 in its extending direction is connected to a substantially middle region of the protector 314 in its extending direction. As shown in FIG. 12, the extension 334*a* extends in a generally T-shaped form along an inner surface of the center cover 313 when the center cover 313 is viewed from inside. Further, one end of a portion of the extension 334*a* extending in the axial direction of the hammer bit 119 is connected to the upper stopper 333 and the other end is connected to the lower stopper 333. The connection part 334 and the extension 334*a* are example embodiments that correspond to the "connecting member" according to the present invention.

Figure 11:
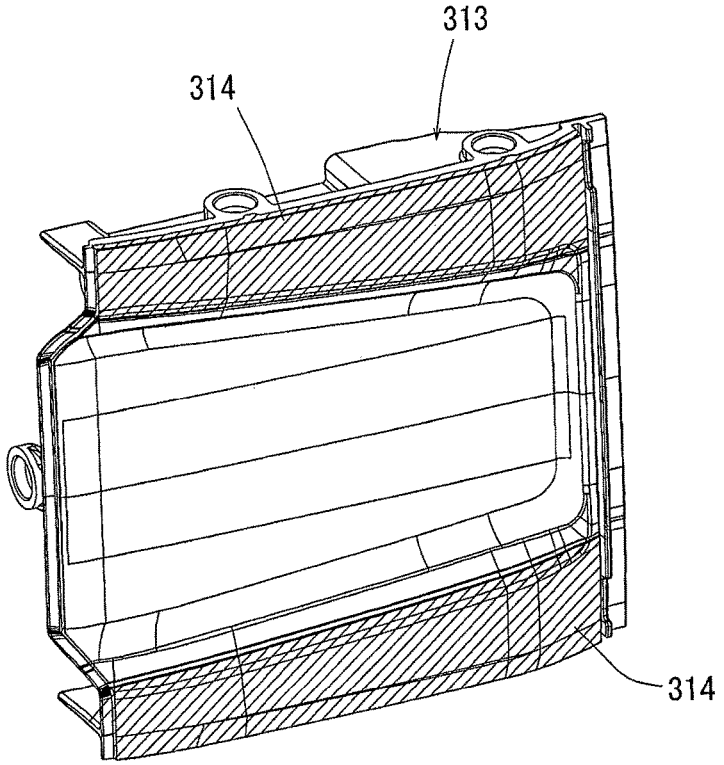
FIG. 11 is a perspective view of a center cover, as viewed from the outside, according to another embodiment of the present invention.

In FIGS. 11 and 12, for the sake of expedience, the protectors 314 and the extensions 334*a* are shaded by oblique lines so as to be clearly distinguished from the center cover 313.

The protectors 314 and the stoppers 333 are formed by a molding method such as insert molding (not shown). Specifically, the center cover 313 is set in a mold formed into a prescribed shape, and then liquid elastomer is filled into the mold and solidified, so that the protectors 314 and the stoppers 333 are formed. In this molding, each of the protectors 314 formed on the outside of the center cover 313 is connected with the pair stoppers 333 formed on the inside of the center cover 313 via the connection part 334 formed in the through hole 313*b* of the center cover 313 and the extension 334*a* extending along the inner surface of the center cover 313. In this manner, the protector 314 and the pair stoppers 333 are integrally formed with each other.

According to this embodiment, with the structure in which each of the protectors 314 disposed on the outside of the center cover 313 and the stoppers 333 disposed on the inside of the center cover 313 are connected with each other by the connection part 334 extending through the center cover 313 and the substantially T-shaped extension 334*a* extending from the connection part 334, the protector 314 and the stoppers 333 can be effectively prevented from coming off the center cover 313.

Although, in this embodiment, the substantially T-shaped extension 334*a* is provided on the inside of the center cover 313, it may be configured such that the protector 314 and the stopper 333 are opposed to each other and directly connected to each other by the connection part 334, so that the substantially T-shaped extension 334*a* may be omitted.

Figure 17:
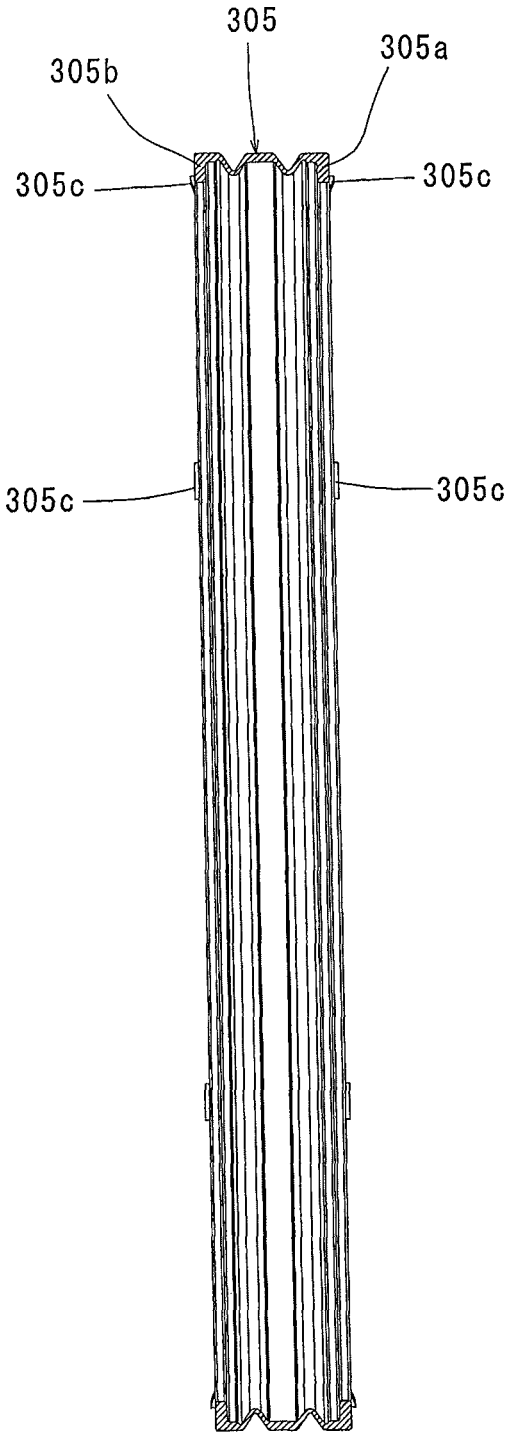
FIG. 17 is a sectional view of the bellows.
Figure 18:
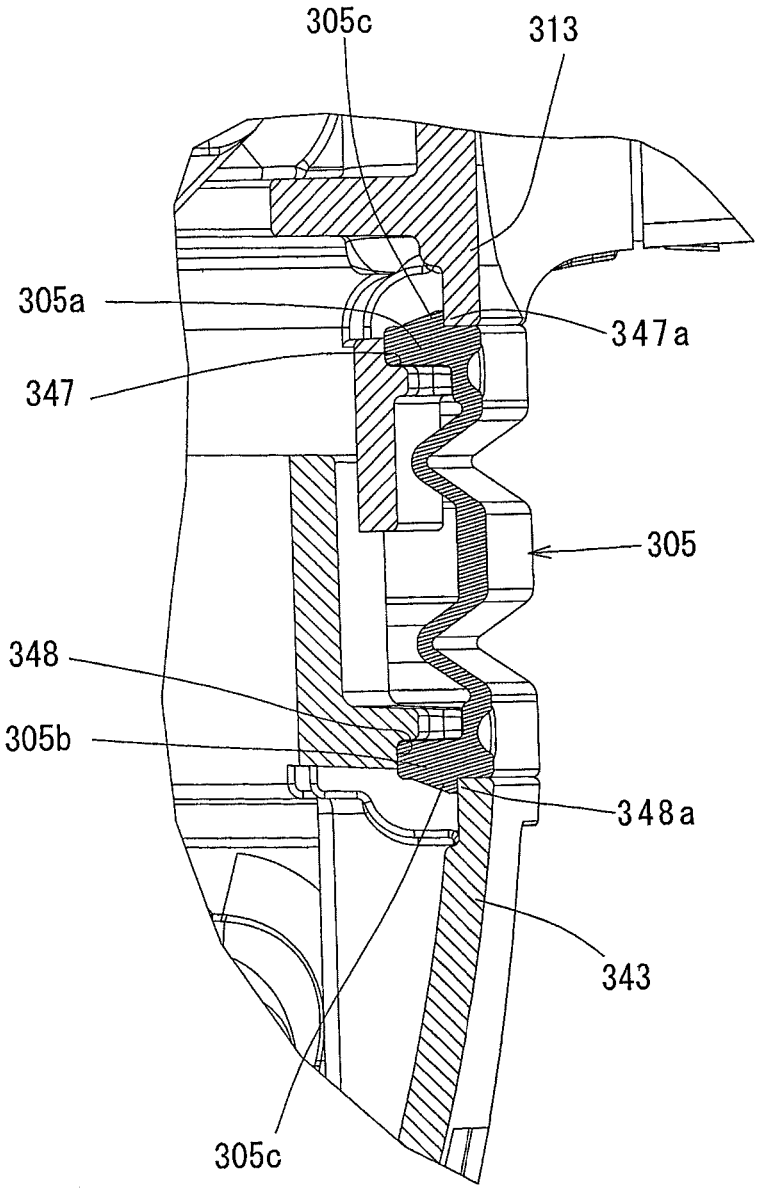
FIG. 18 is a sectional view showing the bellows as mounted.

A further embodiment of the present invention is now explained with reference to FIGS. 16 to 18. This embodiment is a modification to the above-described embodiment relating to the coupling member or the bellows 305 which connects the upper region part 301 and the lower region part 303 so as to allow the parts 301, 303 to move with respect to each other in the axial direction of the hammer bit 119.

Figure 16:
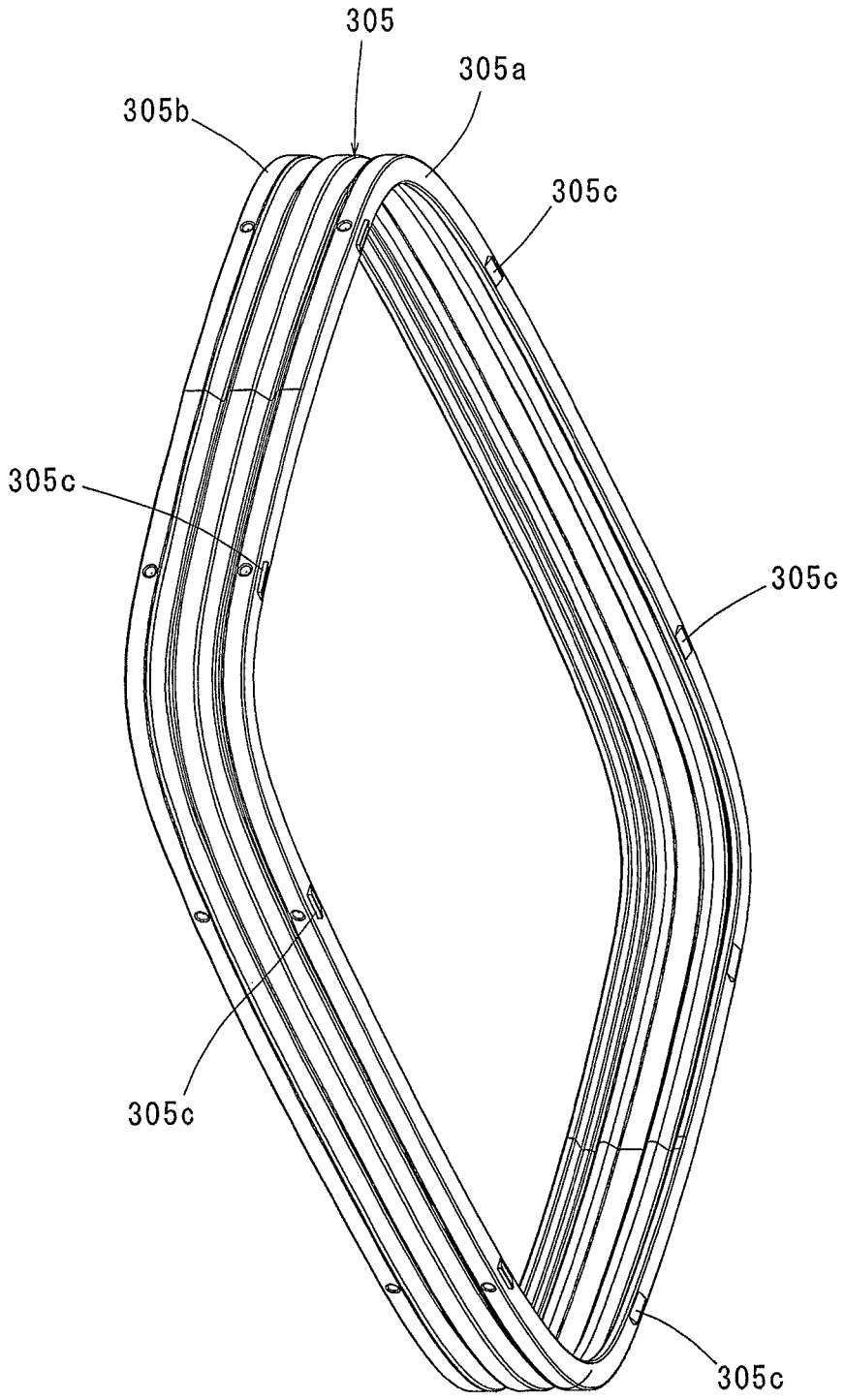
FIG. 16 is a perspective view showing a bellows according to a further embodiment of the present invention.

As shown in FIG. 16, the bellows 305 is annularly formed. As shown in FIG. 18, like in the above-described embodiment, one peripheral edge 305*a* of the bellows 305 is engaged with the engagement recess 347 which is formed in the outer surfaces of the lower end portions of the handle base 311 and the center cover 313 in the upper region part 301, and the other peripheral edge 305*b* is engaged with the engagement recess 348 which is formed in the outer surfaces of the side covers 343 of the lower region part 303 and the outer surface of the body housing 103. In addition, in this embodiment, a plurality of (eight) engagement claws 305*c* are provided on each of end surfaces of the peripheral edges 305*a*, 305*b* of the bellows 305 at predetermined intervals in the circumferential direction (see FIGS. 16 and 17). The engagement claws 305*c* are configured to be elastically locked to locking parts 347*a*, 348*a* which are formed in the engagement recesses 347, 348. Edges of locking holes formed in the engagement recesses 347, 348 forms the locking parts 347*a*, 348*a*, respectively.

According to this embodiment, by provision of the structure in which the engagement claws 305*c* of the bellows 305 are elastically locked to the locking parts 347*a*, 348*a* of the engagement recesses 347, 348, the bellows 305 can be prevented from coming off the upper region part 301, the lower region part 303 and the body housing 103.

In the above-described embodiments, the electric hammer is explained as a representative example of the impact tool, but the present invention may also be applied to a hammer drill which causes the hammer bit 119 to linearly move in the axial direction of the hammer bit 119 and rotate around the axis of the hammer bit 119.

In view of the object of the above-described invention, the following features can be provided.

(Aspect 1)

"An impact tool, which performs a predetermined operation by driving a tool accessory at least in an axial direction of the tool accessory, comprising:

a tool body and a handle, the handle including:

a first covering member that covers one side of the tool body in the axial direction of the tool accessory, an elastic member that is disposed between the tool body and the first covering member, a pair of grips that are fastened to the first covering member and extend therefrom in opposite directions crossing the axial direction, and a second covering member that is disposed on a tool accessory side of the first covering member in the axial direction of the tool accessory and fastened to the tool body and covers the other side of the tool body, wherein:

the grip is configured in a cantilever form having one end fastened to the first covering member, and the first covering member is configured to slide with respect to the tool body and the second covering member via the elastic member in the axial direction."

According to aspect 1, the impact tool is provided in which the handle can be made vibration-proof in a rational manner, while covering the tool body by the covering member.

Correspondences Between the Features of the Embodiments and the Features of the Invention The relationship between the features of the embodiment and the features of the invention and matters used to specify the invention are as follows. Naturally, each feature of the embodiment is only an example for embodiment relating to the corresponding matters to specify the invention, and each feature of the present invention is not limited to this.

The electric hammer 100 is an example embodiment that corresponds to the "impact tool" according to the present invention.

The hammer bit 119 is an example embodiment that corresponds to the "tool accessory" according to the present invention.

The electric motor 110 is an example embodiment that corresponds to the "motor" according to the present invention.

The motion converting mechanism 120 is an example embodiment that corresponds to the "driving mechanism" according to the present invention.

The body 101 is an example embodiment that corresponds to the "tool body" according to the present invention.

The handle 300A is an example embodiment that corresponds to the "handle" according to the present invention.

The grip holding member 300 is an example embodiment that corresponds to the "handle body" according to the present invention.

The handgrip 350 is an example embodiment that corresponds to the "grip" according to the present invention.

The upper region part 301 is an example embodiment that corresponds to the "first part" according to the present invention.

The lower region part 303 is an example embodiment that corresponds to the "second part" according to the present invention.

The compression coil spring 339 is an example embodiment that corresponds to the "elastic member" and the "elastic element" according to the present invention.

The current supply cable 309 is an example embodiment that corresponds to the "current supply cable" according to the present invention.

The bellows 305 is an example embodiment that corresponds to the "coupling member" according to the present invention.

The slide guide 319 is an example embodiment that corresponds to the "guide member" according to the present invention.

The guide shaft 321 is an example embodiment that corresponds to the "guide element" according to the present invention.

The knob 355 is an example embodiment that corresponds to the "second grip" according to the present invention.

The protector 314 is an example embodiment that corresponds to the "protecting member" according to the present invention.

The stopper 333 is an example embodiment that corresponds to the "stopper member" according to the present invention.

The connection part 334 and the extension 334*a* are example embodiments that correspond to the "connecting member" according to the present invention.

DESCRIPTION OF THE NUMERALS

100 electric hammer (impact tool)
101 body (tool body)
103 body housing
104 barrel
110 electric motor (motor)
111 motor shaft
113 gear reducer
119 hammer bit (tool accessory)
120 motion converting mechanism (driving mechanism)
121 crank shaft
123 connecting rod
125 piston
131 tool holder
140 striking mechanism
141 cylinder
141*a* air chamber
143 striker
145 impact bolt
300A handle (handle)
300 grip holding member (handle body)
301 upper region part (first part)
303 lower region part (second part)
305 bellows (coupling member)
305*a* one peripheral edge
305*b* the other peripheral edge
305*c* engagement claw
309 current supply cable (current supply cable)
311 handle base
313 center cover
313*a* guide hole
313*b* through hole
314 protector (protecting member)
315 head cover
317 screw
319 slide guide (guide member)
321 guide shaft (guide element)
323 shaft receiving recess
325 top plate
327 receiving recess
329 screw
331 slide bush
333 stopper (stopper member)
334 connection part (connecting member)
334*a* extension (connecting member)
335 upper contact part
337 lower contact part
339 compression coil spring (elastic member, elastic element)
341 positioning pin
342 positioning hole
343 side cover
345 screw
347 engagement recess
347*a* locking part
348 engagement recess
348*a* locking part
350 handgrip (grip)
350*a* base
351 screw
353 switch
353*a* switch lever
355 knob (second grip)
357 recess
357*a* open space
359 rib
361 screw

What we claim is:

1. An impact tool, which performs a predetermined operation by driving a tool accessory at least in an axial direction of the tool accessory, comprising:

a driving mechanism that drives the tool accessory, a motor that drives the driving mechanism, a tool body that houses the driving mechanism and the motor, a handle, and a current supply cable that is installed on the handle and is provided to supply current to the motor, wherein:

the handle has a handle body that is mounted to the tool body, and a pair of grips that extend in a direction crossing the axial direction of the tool accessory and are designed to be held by user's right and left hands, the handle body has a first part to which the grips are fastened and a second part that is fastened to the tool body and to which the first part is connected so as to be movable with respect to the second part, the first part is connected to the tool body via an elastic member and is allowed to move with respect to the tool body and the second part while being biased by an elastic force of the elastic member, and the current supply cable is installed on the second part of the handle.

2. The impact tool as defined in claim 1, wherein:

the handle body has a coupling member disposed between the first part and the second part, and the coupling member connects the first part and the second part while allowing the first part to move with respect to the second part.

3. The impact tool as defined in claim 1, wherein:

the tool body has a guide member for guiding the first part in the axial direction of the tool accessory, and the guide member comprises a plurality of guide elements that are disposed on an outer periphery of the tool body so as to extend in the axial direction of the tool accessory.

4. The impact tool as defined in claim 3, wherein the elastic member comprises a plurality of elastic elements corresponding to the plurality of guide elements.

5. The impact tool as defined in claim 3, wherein the elastic member is arranged in a position overlapping with the guide member when viewed from a direction crossing the axial direction of the tool accessory.

6. The impact tool as defined in claim 3, wherein the grip is arranged in a position overlapping with the elastic member and the guide member when viewed from a direction crossing the axial direction of the tool accessory.

7. The impact tool as defined in claim 3, wherein:

each of the guide elements is formed in a rod shape, and each of the elastic elements comprises a coil spring and is arranged to surround an outer periphery of the guide element.

8. The impact tool as defined in claim 1, wherein:

the handle has a second grip different from said grip and the second grip is provided in the second part.

9. The impact tool as defined in claim 1, wherein:

the first part is disposed outside of the tool body, the handle body has a protecting member that is arranged to cover at least part of the outside of the first part, and a stopper member that is disposed inside of the first part and defines a moving range of the first part with respect to the tool body, and the protecting member and the stopper member are formed of the same elastic material and are connected to each other by a connecting member formed of the same material as the elastic material.

* * * * *